United States Patent [19]

Checinski

[11] Patent Number: 4,479,101

[45] Date of Patent: Oct. 23, 1984

[54] CIRCUIT BREAKER WITH SELF-ADJUSTING ARMATURE

[75] Inventor: Stanley S. Checinski, Glendale Heights, Ill.

[73] Assignee: Siemens-Allis, Inc., Atlanta, Ga.

[21] Appl. No.: 394,574

[22] Filed: Jul. 2, 1982

[51] Int. Cl.[3] ..... H01H 73/48

[52] U.S. Cl. ..... 335/37; 335/23; 335/174

[58] Field of Search ..... 335/23, 37, 42, 174, 335/176, 35

[56] References Cited

U.S. PATENT DOCUMENTS

| | | | |
|---|---|---|---|
| 2,732,455 | 1/1956 | Ericson et al. | 335/37 |
| 2,902,560 | 9/1959 | Stanback et al. | 335/25 |
| 3,171,921 | 3/1965 | Woods | 337/52 |
| 3,275,959 | 9/1966 | Locher | 335/42 |
| 3,288,965 | 11/1966 | Klein | 335/37 |
| 3,488,610 | 1/1970 | Powell | 335/23 |
| 3,950,715 | 4/1976 | Bagalini et al. | 335/37 |
| 4,156,219 | 5/1979 | Coleman | 335/23 |

*Primary Examiner*—E. A. Goldberg
*Assistant Examiner*—George Andrews
*Attorney, Agent, or Firm*—Frederick W. Powers; John L. James

[57] ABSTRACT

A circuit breaker having an automatically adjusting magnetic armature is provided. The magnetic armature includes a spring-biasing means to automatically maintain one end of the armature in the contact with the electromagnet and the other end away from an adjacent electromagnet. The magnetic armature includes a pair of slightly curved arms which are disposed about a pivot guide post. When current through the circuit breaker exceeds a predetermined amount, the end of the armature normally biased away from the adjacent electromagnet is suddenly attracted to the electromagnet. The force from the spring-biasing means is overcome, and the slightly curved arms of the armature pivot about the pivot guide post so that the armature contacts the adjacent electromagnet. A latch holder at the end of the armature becomes disengaged from a latch means to cause the circuit breaker to open.

3 Claims, 5 Drawing Figures

CIRCUIT BREAKER WITH SELF-ADJUSTING ARMATURE

BACKGROUND OF THE INVENTION

A. Field of the Invention

This invention relates generally to magnetically activated circuit-breaker devices and, more specifically to magnetic armatures for such devices, including a spring-biasing means.

B. Description of the Prior Art

In electric circuit-breaker technology, it is known to use an electromagnetic-tripping means to cause instantaneous tripping of a breaker when current flow through the breaker exceeds a predetermined amount. Typically, the electromagnetic-tripping means will operate when current through the breaker exceeds the rated normal operating current for the breaker by a factor of ten or more.

In electric circuit-breaker device technology, it is also known to use a tripping means in the form of a a bimetallic member which becomes resistively heated by a current flowing through the breaker and which trips the breaker when current flowing through the breaker exceeds a predetermined amount. Typically, the bimetallic-tripping means will operate when current through the breaker exceeds the rated normal operating current for the breaker by a factor of two for a time period of 30 seconds to one minute, for example. Frequently, in circuit-breaker device technology, an electromagnetic-tripping means and a bimetallic-tripping means are used in combination.

Tripping arrangements for circuit breakers usually include a latch member for holding an actuating member of a switching arrangement of the breaker until the breaker is tripped by the latch member so as to unlatch the actuating member. The actuating member is then free to move under the action of a spring means contained in the switching arrangement so that previously closed contacts of the switching arrangement are rapidly opened.

In conventional electromagnetic tripping devices, a magnetic armature 10, such as the type illustrated in FIG. 1, is typically used to activate the tripping mechanism 12. As can be seen from FIG. 1, the magnetic armature provided therein includes a curved portion 14 which surrounds at least one half of the circumference of a guide post 16. A leaf spring 18 is attached to one end 20 of the magnetic armature 10 to maintain the other end 22 of the magnetic armature away from a magnetic yoke 24. When the current flowing through the circuit breaker exceeds a predetermined amount, the magnetic armature 10 is suddenly attracted to the magnetic yoke 24 and tripping mechanism 12 is disconnected from the magnetic armature 10 to cause the circuit breaker to open.

Another magnetic armature is described in U.S. Pat. No. 2,902,560 to Stanback et al. FIG. 1 of the above-noted patent illustrates that the magnetic armature is supported by the yoke, and a spring mechanism is attached to one end of the armature. One difficulty with using the magnetic yoke to support the armature is that the yoke and armature must be assembled together prior to installation within a circuit breaker housing. This greatly complicates the fabrication process of a circuit breaker and prevents easy replacement of the armature. FIG. 1 of U.S. Pat. No. 3,171,921 to Woods illustrates a similar magnetic armature as illustrated in the Stanback et al. patent.

Another type of magnetic armature used by others is illustrated in FIG. 1 of U.S. Pat. No. 4,156,219 to Coleman. This armature is of interest because it includes a spring-biasing means. The armature described therein, however, does not pivot but uses instead a series of vibratory forces to activate a latch mechanism.

SUMMARY OF THE INVENTION

The subject invention is an electrical circuit breaker having an automatically adjusting magnetic armature. The circuit breaker includes a housing formed of an electrically insulative material having a pivot guide. The circuit breaker further includes an electrical current-carrying path means for conducting electrical current within the housing. An electromagnetic means is provided for monitoring current in said current-carrying path means. The electromagnetic means reacts when current through the current-carrying path exceeds a predetermined amount. The electromagnetic means includes an electromagnet partially surrounding one section of the path means and has a fixed relationship to the path means. The electromagnetic means further includes a magnetically conductive armature having a first end provided with at least one slightly curved arm portion contacting the pivot guide of said housing and pivotable thereabout. The armature is disposed in movable juxtaposition with the electromagnet. The armature has a compression spring attached to the first end of the armature to automatically produce a biasing force to maintain a first end of the armature in the contact with the electromagnet and a second end of the armature pivotally away from the electromagnet. The armature is further provided with a latch holder. The electromagnetic means reacts when current through the path means exceeds a predetermined amount by causing the second end of the armature to be attracted toward the electromagnet to overcome the biasing force caused by the spring. The armature thus pivots about the pivot guide of the housing. The circuit breaker is further provided with a latch means for disrupting current flow through the current-carrying path having one end engaged with the latch holder of the armature when the armature is maintained by the biasing force of the spring away from the electromagnet. When the armature pivots toward the electromagnet, the latch disengages from the latch holder and current flow through the current-carrying path is disrupted.

An object of the subject invention is to provide a magnetic armature having a self adjustment means to maintain a first end of the armature in the contact with the electromagnet and a second end of the armature away from the electromagnet during normal operating conditions.

Another object of the subject invention is to provide a magnetic armature which may be maintained by a pivot guide on the housing of a circuit breaker.

Another object of the subject invention is to provide a tripping assembly, including a magnetic armature and an electromagnet or magnetic yoke which may be inserted into the housing of an electrical circuit breaker independently of one another.

Another object of the subject invention is the provision of a magnetic armature which is simple to produce.

Another object of the subject invention is to provide a magnetic armature having reliable operation characteristics.

These and other objects, advantages, and novel features of the present invention will become apparent from the following detailed description of the invention when considered in conjunction with the accompanying drawings.

DETAILED DESCRIPTION OF THE PREFERRED EMBODIMENT

Figure 1:
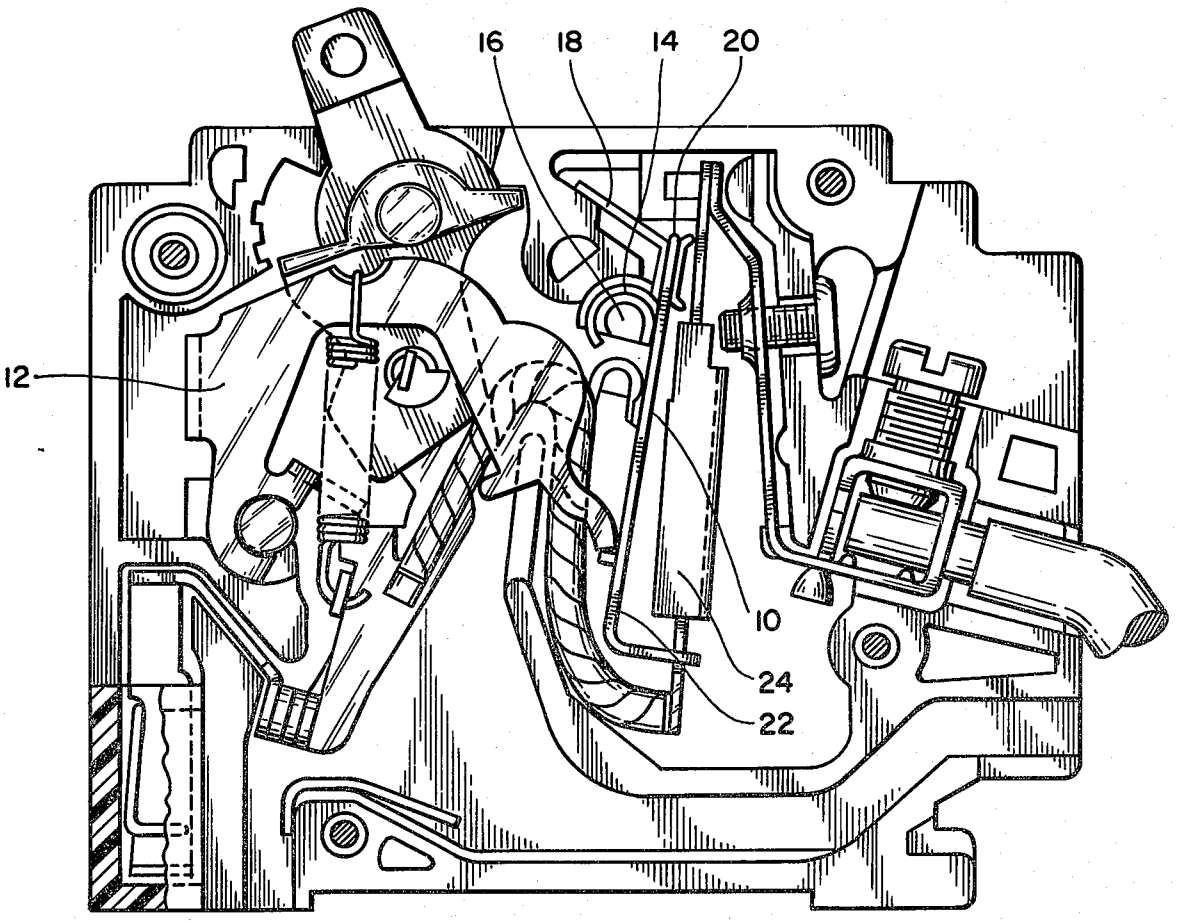
Fig. 1 PRIOR ART
FIG. 1 is an illustration of the circuit breaker including a magnetic armature of which the present invention is an improvement thereof.
Figure 2:
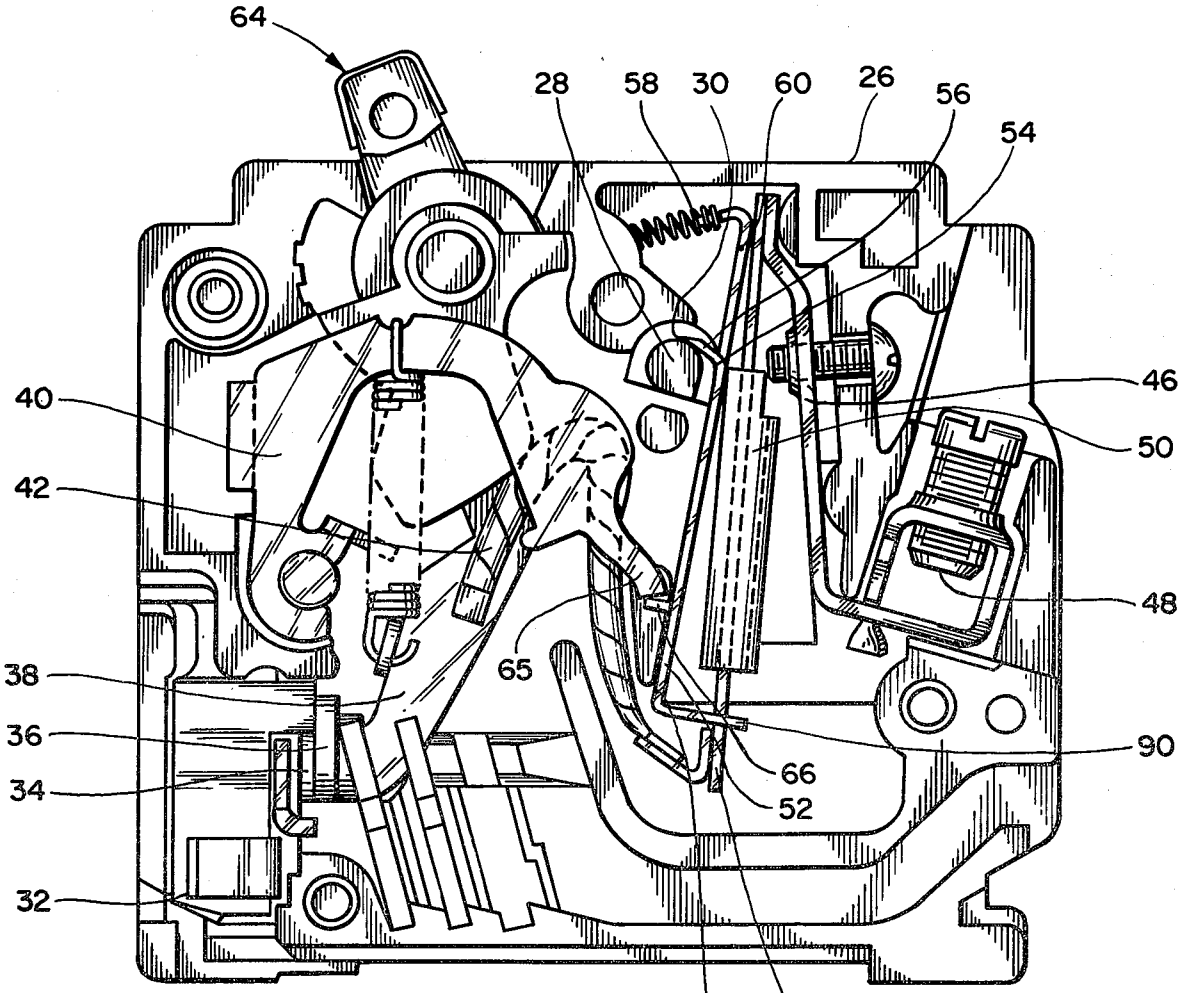
FIG. 2 is a side view of a circuit breaker incorporating the invention with its side cover removed and showing the circuit breaker in the "closed" or "on" position.

Refer now to FIG. 2, which is a side view of a circuit breaker incorporating the subject invention with its side cover removed and showing the circuit breaker in the closed position. The circuit breaker is encased in a housing 26 formed of an electrically insulative material. The housing 26 includes a pivot guide 28. The pivot guide may take a variety of forms; in the preferred embodiment, however, the pivot guide 28 has a pivot surface 30 which is generally circular.

A current-carrying path means in the circuit breaker includes terminal 32 which is in electrical contact with pads 34 and 36. Pad 36, which is a stationary contact, is attached to a movable contact or switching arm 38, which may be activated by cradle 40. Switching arm 38 is electrically connected to electrically conductive copper braid 42 which is, in turn, electrically connected to bimetallic strip 44. Bimetallic strip 44 is, in turn, electrically connected to conducting strap 46. Conducting strap 46 is connected to terminal 48. Current flows through the following elements in the order listed: input terminal 48, conducting strap 46, bimetallic strip 44, conductive braid 42, movable contact or switching arm 38, stationary contact or pad 36, and output terminal or pad 34.

In the preferred embodiment of the subject development, a means 64 for manually pivoting the movable contact switching arm 38 may be provided so that arm 38 may be switched from a closed to an open position with respect to the stationary contact. The purpose of means 64 is to disrupt electrical current flow between the movable contact arm and the stationary contact arm.

The preferred embodiment of the subject development includes an electromagnetic means to monitor current through the current-carrying path means. The electromagnetic means reacts when current through the current-carrying path means exceeds a predetermined amount. The electromagnetic means of the preferred embodiment includes an electromagnet 50 which partially surrounds the current-carrying path means. As can be seen in FIG. 2, in the preferred embodiment, the electromagnet 50 may include a yoke partially surrounding three sides of bimetallic strip 44. The electromagnetic means further includes a magnetically conductive armature 52. In the preferred embodiment, electromagnet 50 has a fixed relationship to the path means while magnetically conductive armature 52 is disposed in movable juxtaposition with the electromagnet. The magnetic armature has a first end 54 provided with at least one slightly curved arm portion 56. The curved arm portion 56 may partially surround guide post 28. The slightly curved arm portion 56 contacts pivot guide 28 of housing 26. Thus, the armature 52 is disposed in movable juxtaposition with electromagnet 50. The armature may include a spring-biasing means for automatically adjusting and maintaining one end of the armature next to one end of the electromagnet and away from the other end of the electromagnet. In the preferred embodiment, the armature 52 may be provided with a compression spring 58 in contact with the first end 54 of the armature 52 to provide the desired automatic adjustment.

In the preferred embodiment, the first end 54 may include an extension 60 to receive compression spring 58. One purpose of compression spring 58 is to produce a biasing force to maintain a first end of the armature in the contact with the electromagnet and a second end 62 of the armature away from electromagnet 50 and bimetallic strip 44 under normal operating conditions.

When current through the current path of the circuit breaker exceeds a predetermined amount, the electromagnetic means reacts by causing the second end of the armature to be attracted toward the electromagnet 50 to overcome the biasing force of compression spring 58 and forces created by a latch, as discussed hereinbelow. This causes the armature 52 to pivot about pivot guide 28 of housing 26.

The circuit breaker of the preferred embodiment further includes a latch means 64 for electrically disconnecting movable contact 38 from stationary contact pad 34. The latch means 64 has one end 65 in engagement with a latch holder 66 of armature 52. The latch means 64 is in engagement with latch holder 66 when compression spring 58 is maintaining armature 52 away from electromagnet 50. When current through the current path exceeds a predetermined amount and armature 52 is attracted toward electromagnet 50, one end 65 of the latch means 64 becomes disengaged from latch holder 66 to electrically disconnect movable contact 38 from stationary contact pad 34.

Figure 3:
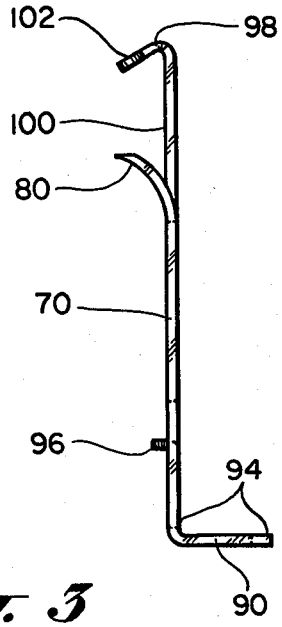
FIG. 3 is a side view of the subject magnetic armature.
Figure 4:
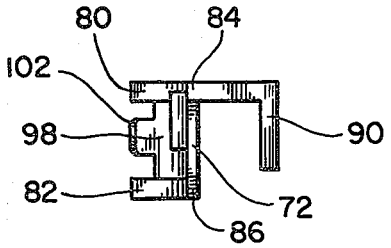
FIG. 4 is a bottom end view of the subject magnetic armature.
Figure 5:
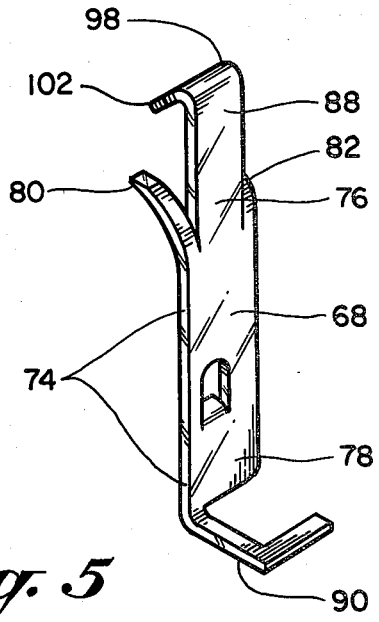
FIG. 5 is a isometric view of the subject magnetic armature.

Referring now to FIGS. 3–5, it is possible to easily view the preferred embodiment or best mode design of the subject magnetic armature. Very basically, the magnetic armature includes a rectangularly shaped piece 68 of magnetically conductive material. The rectangularly shaped piece has a thickness 70, FIG. 3, which is relatively small with respect to the width 72, FIG. 4, of the piece. The width 72 is also relatively small with respect to the length 74, FIG. 5, of the piece. The piece 68 includes first 76 and second 78 ends, FIG. 5, along the width of the piece. The first end 76 is provided with a forwardly extending pair of curved arms 80 and 82. Each arm is disposed on opposite side portions 84, 86 of the width of the piece so that a central straight end portion 88 of the first end 76 is disposed between the pair of arms 80, 82. The rectangularly shaped piece 68 further includes a second end hook extension 90. The hook extends backwardly from said piece and angularly upward toward the piece to form a U-shaped curve 94 along the thickness of the rectangularly shaped piece at the second end 78. The piece further includes a forwardly extending notch portion 96. The notch portion is disposed toward the second end 78 of the rectangularly shaped piece 68. In the preferred embodiment, the forwardly extending notch portion 96 serves as the latch holder.

The magnetic armature member may further include a notch 98 along the centrally disposed straight end portion 88 and extending outwardly and forwardly from the rectangular piece 68 toward arms 80 and 82. In the preferred embodiment, a compressible spring may be disposed on the other end 102 of the notch 98.

Referring now to FIG. 5, in combination with FIG. 2, it is important to note that forward hook extension 90 of the rectangularly shaped piece 68 is disposed about three sides of bimetallic strip 44. This provides additional protection in limiting the movement of the second end 62 of armature 52 about the bimetallic strip 44. Thus, compression spring 58 and hook 90 may work in concert in the preferred embodiment to maintain the armature 52 within a limited range of pivotable movement about pivot guide 28. However, by designing hook 90 to surround only three sides of bimetallic strip 44, it is possible to assemble and disassemble armature 52 from housing 26 in a completely separate stage from the assembly and disassembly of bimetallic strip 44 from housing 26.

Although the invention has been described and illustrated in detail, it is to be clearly understood that the same is by way of illustration and example only, and it is not to be taken by way of limitation; the spirit and scope of this invention being limited only by the terms of the appended claims.

I claim:

1. A magnetic armature member of a circuit breaker, comprising;

a rectangularly shaped piece of magnetically conductive material, said rectangularly shaped piece having a thickness which is less than the width of said piece, said width being less than the length of said piece, said piece having first and second ends along the width of said piece, said first end being provided with a forwardly extending pair of curved arms oppositely disposed so that a central end portion of said first end is disposed between said pair of arms, said piece further including at said second end a hook extension, said hook extending backwardly and angularly to form a U-shaped curve along the thickness of said piece at said second end, said piece further including a forwardly extending notch portion, said notch portion being disposed toward said second end of said piece; and a notch attached to said piece at said centrally disposed straight end portion and extending outwardly from said end and forwardly toward said arms.

2. An electrical circuit breaker, comprising:

a housing made from electrically insulated material including a pivot guide post;

an electrical current-carrying path in which current flows through the following elements in the order listed:

an input terminal, a conducting strap connected to said input terminal, a bimetallic strip connected to said conducting strap, a movable contact switching arm connected to said conductive braid, a stationary contact contacting said movable contact, an output terminal connected to said stationary contact;

means for manually pivoting said movable contact arm from a closed to an open position with rspect to said stationary contact to disrupt electrical current flow between said movable contact arm and said stationary contact;

a magnetic yoke having a first end and partially surrounding said bimetallic strip;

a magnetic armature in movable juxtaposition with said yoke, said armature having a first end having at least one curved arm portion to partially surround said guide post, said first end further including a spring-biasing means for automatically adjusting and maintaining a first end of said armature in contact with the first end of said yoke and a second end of said armature biased away from said yoke and said bimetallic strip, said second end of said armature being provided with a latch holder, said second end of said armature being pivotably attracted toward said yoke when current through said bimetallic strip exceeds a predetermined amount; and a latch means for electrically disconnecting said movable contact from said stationary contact, said latch means having one end in engagement with said latch holder when said spring-biasing means maintains said second end away from said yoke, said latch means being disengaged from said holder to electrically disconnect said movable contact from said stationary contact when said second end is attracted toward said yoke.

3. A circuit breaker as recited in claim 2, wherein said arm portion surrounds one fourth of the circumference of said pivot guide post.

* * * * *